United States Patent [19]

Weinerman et al.

[11] Patent Number: 4,892,338

[45] Date of Patent: Jan. 9, 1990

[54] PLURAL POINT DOOR LOCK AND FLUSH-MOUNTABLE OPERATING MECHANISM WITH DETENT

[75] Inventors: Lee S. Weinerman, Medina; Joseph P. Spinelli, Jr., Seville; Michael J. Rachocki, Columbia Station, all of Ohio

[73] Assignee: The Eastern Company, Cleveland, Ohio

[21] Appl. No.: 257,837

[22] Filed: Oct. 13, 1988

[51] Int. Cl.[4] ..... E05C 1/12

[52] U.S. Cl. ..... 292/35; 292/166

[58] Field of Search ..... 292/34, 35, 36, 38, 292/166

[56] References Cited

U.S. PATENT DOCUMENTS

| | | | |
|---|---|---|---|
| 1,593,435 | 7/1926 | Carter | 292/35 X |
| 2,560,459 | 7/1951 | Lundberg et al. | 292/35 |
| 4,138,869 | 2/1979 | Pelcin | 70/151 |
| 4,320,642 | 3/1982 | Pastva, Jr. | 70/472 |
| 4,321,812 | 3/1982 | Pelcin | 70/472 |
| 4,438,964 | 3/1984 | Peters | 292/216 |

*Primary Examiner*—Gary L. Smith
*Assistant Examiner*—Michael J. Milano
*Attorney, Agent, or Firm*—David A. Burge

[57] ABSTRACT

A door lock includes a plurality of latch bolt assemblies that are mountable on a door at spaced locations about the periphery of the door, an operating mechanism that is flush-mountable on the door at a central location, and elongate linkage elements for interconnecting the operating mechanism with the latch bolt assemblies to enable the operating mechanism to concurrently operate the latch bolt assemblies. The operating mechanism includes a pan-shaped housing, a paddle handle that is mounted on the housing for pivotal movement between a nested position and an extended position, a slide that is track-mounted for sliding movement relative to the housing between first and second positions, a pair of operating arms that are and are pivotally connected to the housing for movement between latched and unlatched positions in response to movement of the slide, and a detent that is interposed between the housing and the slide for assisting to releasably retain the slide in its first and second positions, and to releasably retain the arms in their latched and unlatched positions.

20 Claims, 5 Drawing Sheets

PLURAL POINT DOOR LOCK AND FLUSH-MOUNTABLE OPERATING MECHANISM WITH DETENT

REFERENCE TO RELEVANT PATENTS

Reference is made to the following patents:

Combined Latch Operating Handle and Handle Housing, U.S. Des. Pat. No. 292,482 issued Oct. 27, 1987 to Lee S. Weinerman and Michael J. Rachocki, referred to hereinafter as the "Design Patent;"

Cabinet Lock with Recessed Handle, U.S. Pat. No. 4,683,736 issued Aug. 4, 1987 to Lee S. Weinerman, Michael J. Rachocki and John E. Giarrizzo, referred to hereinafter as the "Grooved Slide Bolt Patent;"

Flush-Type Door Lock, U.S. Pat. Pat. No. 4,231,597 issued Nov. 4, 1980 to Albert L. Pelcin, referred to hereinafter as the "Paddle Lock With Detent Patent;"

Detent System for Releasably Retaining Relatively Movable Members in Predetermined Positions, U.S. Pat. No. 4,126,340 issued Nov. 21, 1978 to Albert L. Pelcin, referred to hereinafter as the "Detent Patent;"

Multiple-Point Flush Door Lock, U.S. Pat. No. 2,735,706 issued Feb. 21, 1956 to Albert L. Pelcin, referred to hereinafter as the "Multiple Bolt Patent;" and, Combined Lock and Latch, U.S. Pat. No. 981,843 issued Jan. 17, 1911 to Herman Davis, referred to hereinafter as the "Multiple Slide Bolt Patent."

BACKGROUND OF THE INVENTION

1. Field of the Invention

The present invention relates to latches and locks for use on swinging doors of vehicles, industrial cabinets, electrical equipment enclosures and the like wherein there is a need for a closure to be held in its closed position by a plurality of latch bolts that are positioned in spaced relationship about the periphery of the closure, and that are operated concurrently by a remotely located, flush-mounted operating mechanism. More particularly, the present invention relates to a plural point latch or lock that has a flush-mountable operating mechanism for concurrently operating a plurality of remotely located latch bolts, with the operating mechanism having a pan-shaped housing that defines a recess that extends forwardly from a back wall of the housing, a paddle handle that is positioned forwardly with respect to the back wall and is mounted on the housing for pivotal movement between a nested position and an extended position, a slide that is positioned rearwardly with respect to the back wall and is track-mounted for sliding movement relative to the housing between first and second positions, a pair of operating arms that are positioned rearwardly with respect to the back wall and are pivotally connected to the housing for movement between latched and unlatched positions in response to movement of the side between its first and second positions, and a detent that is interposed between the housing and the slide for assisting to releasably retain the slide in its first and second positions, whereby the detent also serves to releasably retain the paddle handle in its nested and extended positions, and to releasably retain the arms in their latched and unlatched positions.

2. Prior Art

Plural point latch and lock systems of a variety of types have been proposed for use with a closure to releasably retain the closure in its closed position through the use of a plurality of latch bolts that are positioned at spaced locations about the periphery of the closure, with the latch bolts being operated concurrently by a remotely located operating mechanism that includes a movable handle. The referenced Multiple Slide Bolt Patent discloses one such system wherein a plurality of latch bolt assemblies are located at positions spaced about the perimeter of a door, and are operated concurrently by a centrally located device that is coupled by elongate rods to the latch bolt assemblies.

The referenced Multiple Bolt Patent discloses a plural-point locking system, including spring-projected latch bolt assemblies that have a capability to be "slammed" into engagement with suitably configured strikes—whereby it is possible to latch the latch bolt assemblies into engagement with associated strikes without having to operate a centrally located operating handle in order to retract the latch bolts. The locking system of the referenced Multiple Bolt Patent includes a paddle-type operating handle that is a pivotally mounted paddle-type handle that is movable between nested and extended positions with respect to a pan-type housing that defines a forwardly-fainting recess. Pivotal movement of the handle between its nested and extended positions causes a housing-mounted latch bolt to slide between first and second positions, and to concurrently move a pair of rods that are connected to the latch bolt assemblies, whereby all of the latch bolts of the locking system are operated concurrently as the result of pivoting the handle from its nested to its extended position.

Detent devices of a variety of types have been proposed for use with relatively movable latch and lock components to facilitate releasably retaining relatively movable latch and lock components in predetermined relative positions. In this regard, the referenced Detent Patent discloses a variety of ways in which a spring-clip mounted detent member can be positioned in a hole that is formed in one of two relatively movable components to assist in providing a "detent" action that will releasably retain the two relatively movable components in a predetermined position when the detent engages a detent receiving formation that is provided on the other of the components. The referenced Detent Patent provides a variety of examples of ways in which the described detent system can be utilized in conjunction with latch and lock components, including an example wherein the detent is used with a pair of opposed, projectable-retractable rod-like deadbolt members that are concurrently operated by rotating a handle that can be folded so as to nest in a housing recess.

The referenced Paddle Lock With Detent Patent relates to a flush-mountable latch or lock having a spring-projected slide bolt that is operated by a paddle-type handle. The handle is pivotally mounted for movement between a nested position within a forwardly facing recess that is defined by a pan-type housing, and an extended position. A spring-projected detent element in the form of a hardened steel ball is carried in a transversely extending passage that is formed in the slide bolt, and is engageable with a pair of spaced detent receiving formations that are defined in a wall of a stamping that is mounted on a back wall of the housing. However, the invention of this patent does not provide a plural-point latch or lock; nor does it provide a mechanism for operating a remotely located latch bolt.

Another prior proposal—which has been embodied in a commercially available product—provides a plural point latch or lock having a flush-mountable operating mechanism for remotely operating a plurality of latch bolts. The operating mechanism has a housing that defines a recess that extends forwardly from a back wall of the housing, a paddle handle that is positioned forwardly with respect to the back wall and is mounted on the housing for pivotal movement between a nested position and an extended position, a slide that is positioned rearwardly with respect to the back wall and is carried within a slide channel for movement relative to the housing between first and second positions, and a pair of operating arms that are positioned rearwardly with respect to the back wall and are pivotally connected to the housing for movement between latched and unlatched positions in response to movement of the side between its first and second positions. The product that embodies this proposal is sold by the Eberhard Manufacturing Company division of The Eastern Company, Cleveland, Ohio 44136, under the product designations 4972 and 4974. However, this product does not provide a detent for releasably retaining the slide in its first and second positions, or for releasably retaining the paddle handle in its nested and extended positions, or for releasably retaining the pivotal arms in their latched and unlatched positions.

The referenced Grooved Slide Bolt Patent discloses the use of a slide member, namely a spring projected slide bolt, that has grooves in opposed side portions thereof that receive in mating engagement therewith a pair of opposed housing formations, by which arrangement with slide bolt is mounted for linear, sliding movement relative to the housing. The referenced Design Patent is cited herewith inasmuch as it is a "companion case" to the referenced Grooved Slide Bolt Patent and discloses features of the handle and housing that are used in the preferred practice of the invention of the referenced Grooved Slide Bolt Patent.

SUMMARY OF THE INVENTION

The present invention addresses the foregoing and other drawbacks of the prior art, and provides a novel and improved plural point latch or lock having a flush mountable operating mechanism for concurrently operating a plurality of latch bolts, and for providing a detent that is operable to releasably retain various relatively movable components of the latch or lock in predetermined positions.

A feature of the present invention resides in the provision of a flush-mountable operating mechanism for concurrently operating a plurality of remotely located latch bolts, with the operating mechanism having a housing that defines a recess that extends forwardly from a back wall of the housing, a paddle handle that is positioned forwardly with respect to the back wall and is mounted on the housing for pivotal movement between a nested position and an extended position, a slide that is positioned rearwardly with respect to the back wall and is track-mounted for sliding movement relative to the housing between first and second positions, a pair of operating arms that are positioned rearwardly with respect to the back wall and are pivotally connected to the housing for movement between latched and unlatched positions in response to movement of the side between its first and second positions, and a detent that is interposed between the housing and the slide for assisting to releasably retain the slide in its first and second positions, whereby the detent also serves to releasably retain the paddle handle in its nested and extended positions, and to releasably retain the arms in their latched and unlatched positions.

Stated in another way, a feature of the present invention reside in the provision of a flush-mountable operating mechanism for a plural point latch or lock, with the operating mechanism addressing needs that are not addressed by prior proposals that are embodied in Eberhard products that are designated by the numbers 4972 and 4974. Other features reside in the provision of latch and lock products that, in the preferred practice of the present invention, incorporate the improved operating mechanism so as to provide latch and lock products that offer structural improvements over the configurations and arrangements of parts that are utilized in prior Eberhard products.

Latches and locks that embody the preferred practice of the present invention include a plurality of latch bolt assemblies for attachment to a closure at spaced locations about the periphery of the closure, a flush-mountable operating mechanism of the type described above, and elongate linkage elements for drivingly interconnecting the operating mechanism with the latch bolt assemblies.

In accordance with the most preferred practice of the present invention, the operating mechanism is a relatively compact, relatively thin unit that can be mounted in an opening that is formed through at least a front panel of a door, including a housing that has side and back walls that cooperate to define a forwardly facing recess. An opening is formed through the back wall. A slide mounting plate is mounted to extend along the back wall of the housing. An elongate slide is positioned in a track that is defined by the mounting plate, and is thereby slidably supported on the housing at a location behind a portion of the back wall. The slide is movable between first and second positions relative to the housing. A key control may be mounted on the housing at a location near one end of the slide track. The key control carries a cam that is movable between a locked position wherein the cam prevents movement of the slide away from its first position, and an unlocked position wherein the cam permits movement of the slide between its first and second positions. A paddle-type handle is mounted on the housing and is movable between a nested position wherein the handle is nested within the recess, and an extended position wherein a substantial portion of the handle projects from the recess. A detent is interposed between the housing and the slide for selectively releasably retaining the slide in its first and second positions. The detent also preferably serves the function of assisting in effecting final movements of the slide toward and into its first and second positions as the slide approaches these positions.

A driving connection is formed between the handle and the slide by a projecting portion of the handle that extends rearwardly from within the housing recess, through the opening formed in the back wall of the housing, and into a receiving formation that is provided on the slide. The driving connection that is established between the housing projection and the slide is operable to move the slide toward its second position when the handle is pivoted toward its extended position, to move the slide toward its first position when the handle is pivoted toward its nested position, to releasably retain the handle in its nested position when the slide is releasably retained in its first position by the detent, and to releasably retain the handle in its extended position when the slide is releasably retained in its second position by the detent.

A feature of this combination and arrangement of parts is that very few if any of the parts require precision machining. Any play which occurs between the relatively movable parts tends to be compensated for by the operation of the detent. None of the relatively movable parts are free to rattle when the lock is subjected to vibration. When the handle is nested and the slide is in its first position, the biasing action of the detent tends to maintain rattle-free engagement between the handle and housing, and a rattle-free mounting of the slide in its slide track.

The detent preferably includes a hardened steel ball that is carried in a closed-ended hole that is formed directly in the material of the slide. A compression coil spring is carried in the closed-ended hole and biases the ball outwardly toward the back wall of the housing. Spaced dimple-like depressions are formed in the back wall of the housing to receive the ball when the slide is in either of its first or second positions. The biasing action of the compression coil spring tends to force the ball into one of the dimple-lie depressions as the slide approaches either of its first or second positions. This biasing action is quite strong and is utilized to assist in effecting final movement of the slide to its first and second positions.

The spaced dimple-like depressions that are formed in the back wall of the housing to receive the detent ball may be of differing configuration to provide greater and lesser degrees of retention force depending on which of the formations is engaged by the detent ball.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
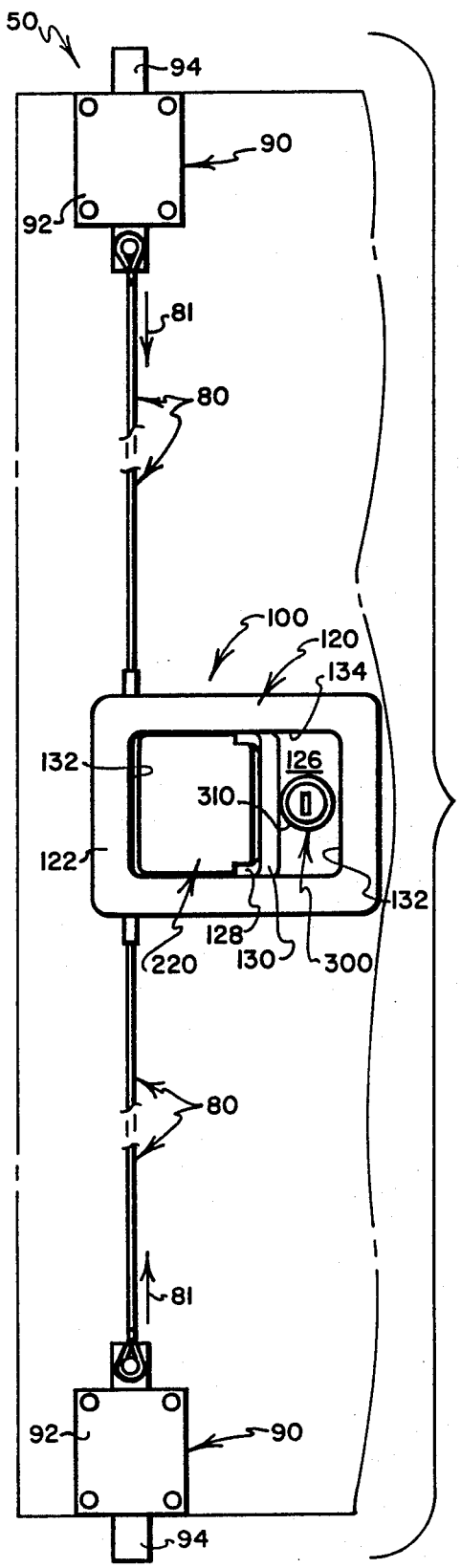
FIG. 1 is a front side elevational view of one embodiment of a plural-point door lock that has a flush-mountable operating mechanism that incorporates features of the present invention, with portions of two elongate cables that interconnect the operating mechanism with a pair of remotely located slide bolt assemblies being foreshortened, and with portions of a door on which the lock is mounted being outlined in phantom.

Referring to FIG. 1, one embodiment of a plural-point door lock that incorporates features of the preferred practice of the present invention is indicated generally by the numeral 50. The lock 50 includes an operating mechanism 100 that is located substantially "centrally" between a pair of relatively "remotely" located latch bolt mechanisms 90.

Figure 2:
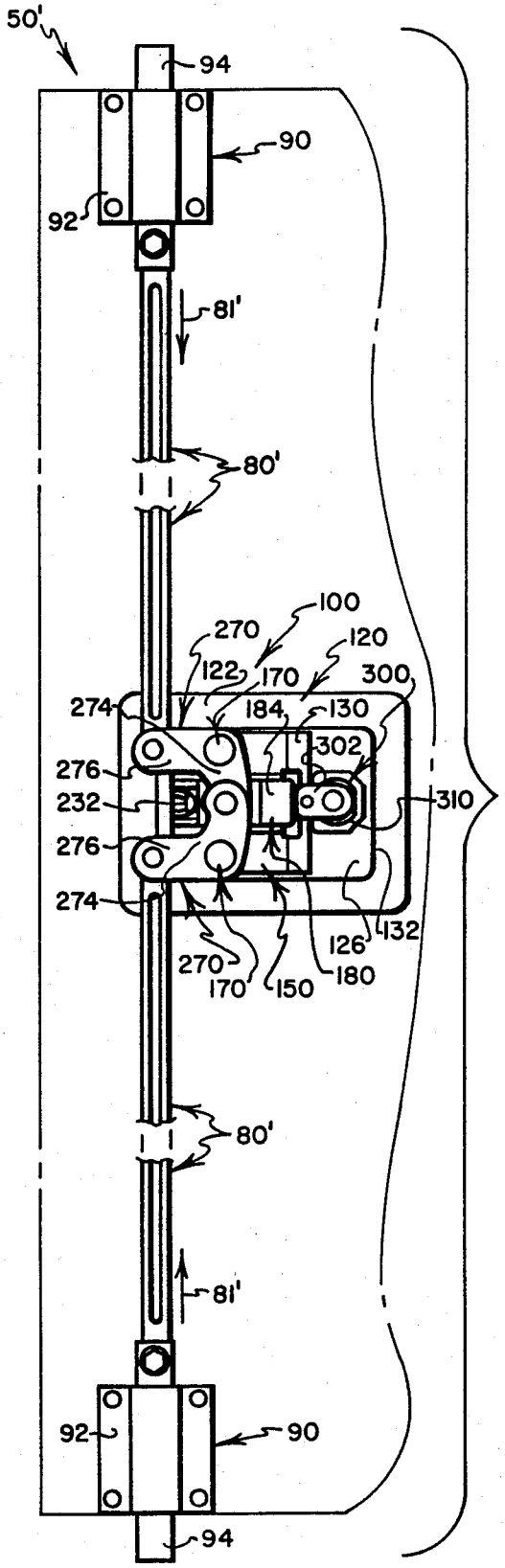
FIG. 2 is a rear side elevational view of another embodiment of a plural-point door lock that utilizes the flush-type operating mechanism of FIG. 1, with portions of two elongate rods that interconnect the operating mechanism with a pair of remotely located slide bolt assemblies being foreshortened, and with portions of a door on which the lock is mounted being outlined in phantom.

Referring to FIG. 2, another embodiment of a plural-point flush type door lock that incorporates features of the preferred practice of the present invention is indicated generally by the numeral 50'. The lock 50' is identical to the lock 50 insofar as it includes the operating mechanism 100 at a central location between the latch bolt mechanisms 90. In the lock embodiment 50 of FIG. 1, a pair of cables 80 flexibly connect the operating mechanism 100 with the latch bolt mechanisms 90 for selectively providing tension in directions that are indicated by arrows 81 for operating the latch bolt mechanisms 90 to retract latch bolts 94 that normally project from housings 92 of the latch bolt mechanisms 90, as will be explained. The lock embodiment 50' of FIG. 2 differs from the lock embodiment 50 of FIG. 1 in that, instead of providing flexible cables 80, a pair of elongate rod members 80' are provided to rigidly interconnect the operating mechanism 100 with the latch bolt mechanisms 90 for selectively providing tension in directions that are indicated by arrows 81' for operating the latch bolt mechanisms 90 to retract the latch bolts 94.

Figure 13:
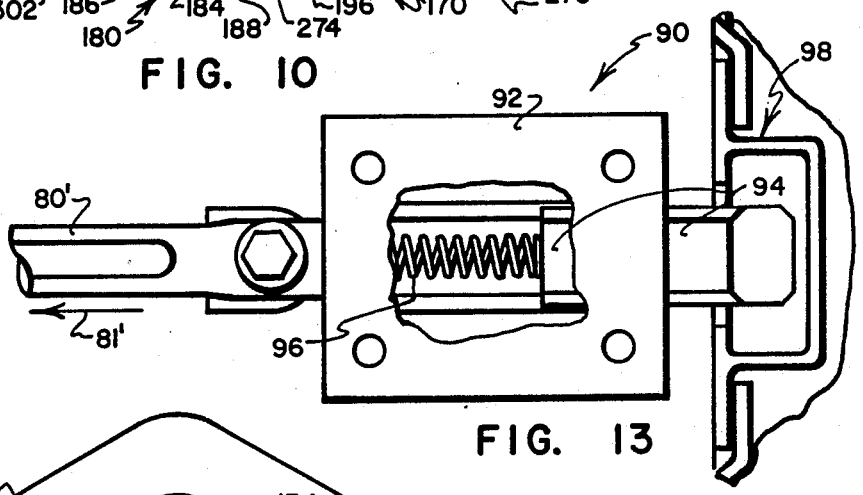
FIG. 13 is a front side elevational view, on an enlarged scale, of one of the latch bolt assemblies that is depicted in FIG. 2, together with portions of an associated strike and portions of a door frame on which the strike is mounted, with portions thereof broken away to permit underlying features to be seen; and, FIG. 14 is a perspective view similar to FIG. 3 but depicting an operating mechanism that does not feature a key-locking capability.

The latch bolt mechanisms 90 can take any of a variety of commercially available forms, including slide bolt assemblies such as are depicted in the referenced Multiple Bolt Patent or the referenced Multiple Slide Bolt Patent, or such slide bolt assemblies as are sold by the Eberhard Manufacturing Company division of The Eastern Company, Cleveland, Ohio 44136 under product designations 10-5597, 4974-52 or 5638U. Referring to FIG. 13, one of the latch bolt assemblies 90 that is utilized in the lock 50' of FIG. 2 is depicted as taking the form of Eberhard product 4974-52. The assembly 90 has a welded casing 92 that houses portions of a latch bolt 94. A compression coil spring 96 is carried within the confines of the casing 92 and biases the latch bolt 94 toward an extended position that is depicted in FIG. 13. The rod member 80' that connects with the depicted latch bolt assembly 90 functions in response to operation of the centrally located mechanism 100 to retract the latch bolt 94 (in the direction of the arrow 81') so that the latch bolt 94 will disengage a conventional strike 98 that is provided to latchingly receive the latch bolt 94 when the door on which the latch bolt assembly 90 is mounted is closed.

Referring to FIGS. 3–12, the lock operating mechanism 100 is a key-controlled, paddle-handle, flush-mountable unit that is adapted to be supported on such structures as a swinging door (not shown) for relative movement therewith to bring the latch bolt assemblies 90 of such latch or lock units as the locks 50, 50' into and out of juxtaposition with suitably configured conventional strikes (such as the strike 98 that is depicted in FIG. 13). Typically a separate strike is associated with each of the latch assemblies 90 that are supported on a door frame or on other structure (not shown) that extends about the perimeter of the closed door. The manner in which locks of this general type are mounted on doors is well known to those skilled in the art, and is described and illustrated in such patents as the referenced Multiple Bolt Patent and the referenced Multiple Slide Bolt Patent.

In overview, the operating mechanism 100 includes a pan-shaped housing 120 that nests and pivotally mounts a handle 220. The handle 220 is movable relative to the housing 120 between a normally nested position (shown in FIGS. 1, 3, 6 and 7) and an extended position (shown in FIGS. 9 and 10) to effect movement of a slide 180 along a linear track 160 that is defined by a mounting plate 150. Movement of the slide 180, in turn, effects counter-rotation of a pair of arms 270 (compare FIGS. 5 and 8) that are connected to the elongate linkage members 80 or 80' (see FIG. 2) to operate the latch bolt assemblies 90 of the lock 50 or 50'.

Figure 5:
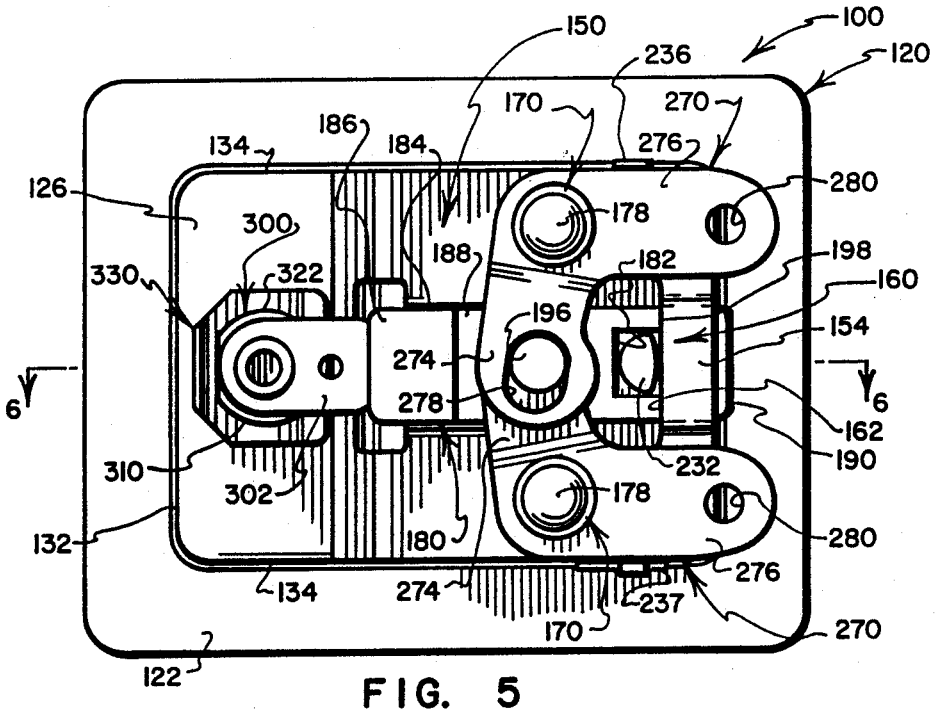
FIG. 5 is a rear side elevational view thereof.
Figure 6:
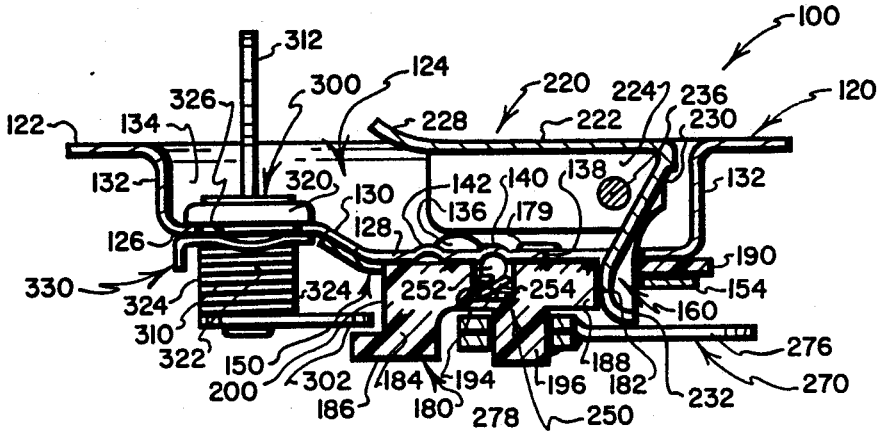
FIG. 6 is a sectional view as seen from a plane indicated by, a line 6—6 in FIG. 5.
Figure 7:
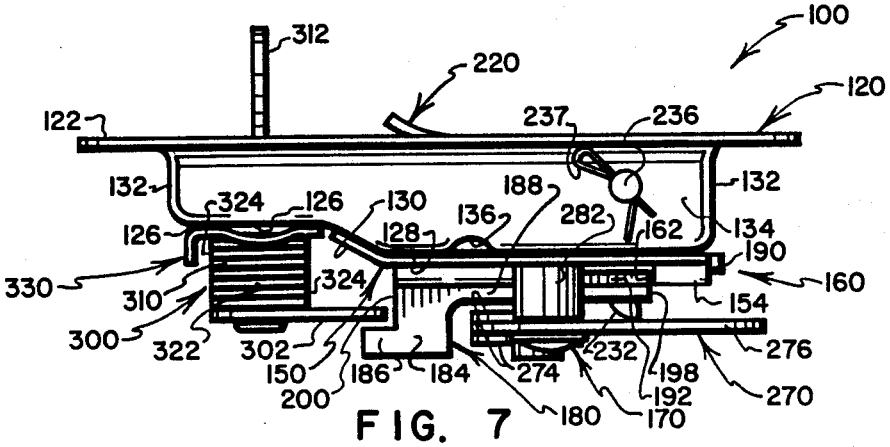
FIG. 7 is a bottom plan view thereof.
Figure 8:
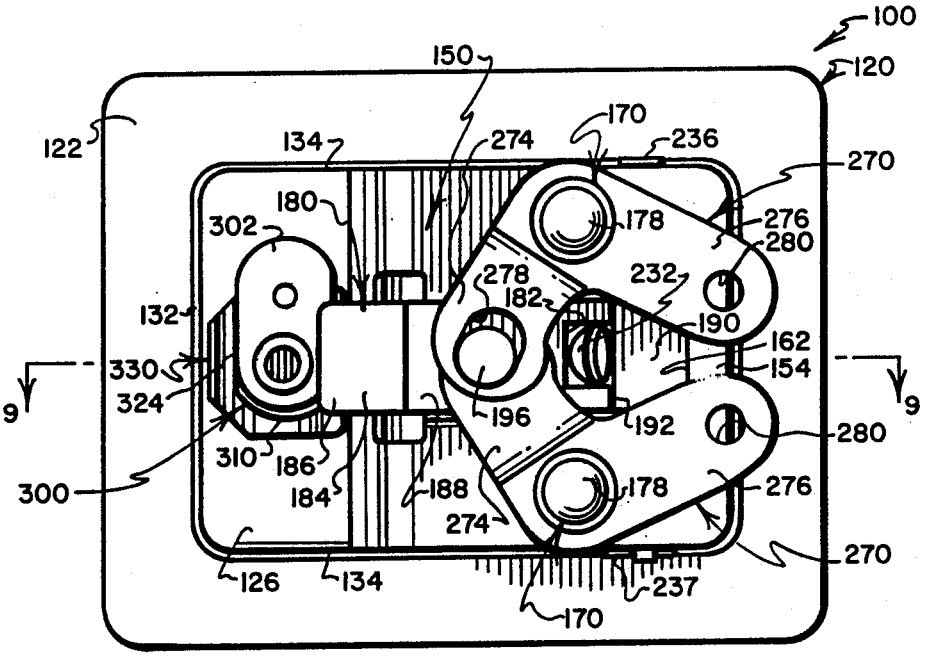
FIG. 8 is a rear side elevational view similar to FIG. 5 but with components of the mechanism being "unlocked" and with the handle being shown in an extended position.
Figure 9:
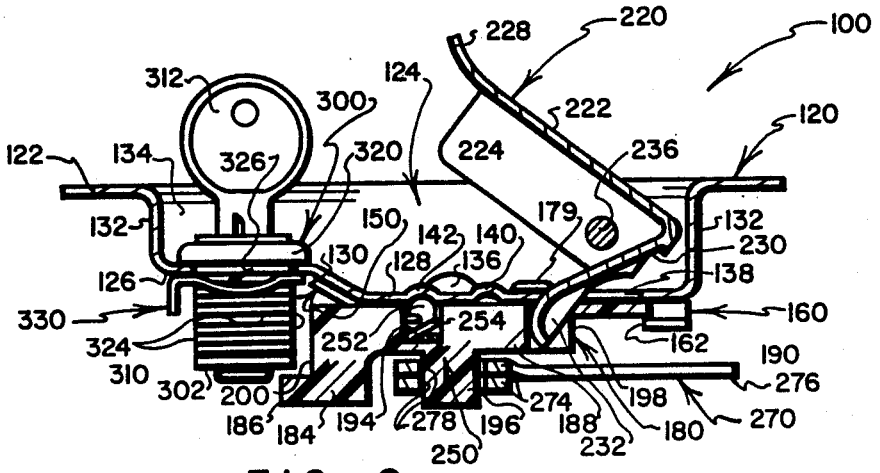
FIG. 9 is a sectional view as seen from a plane indicated by a line 9—9 in FIG. 8.

The operating mechanism 100 that is depicted in FIGS. 3–11 is of a key-locking type, meaning that it includes a key operated locking device 300 that is mounted on the right back wall portion 126. Referring to FIGS. 5 and 8 (or to FIGS. 7 and 9), it will be seen that the locking device 300 includes a cam member 302 that is movable between a locked position, shown in FIGS. 5 and 7, and an unlocked position, shown in FIGS. 8 and 9. In FIGS. 5 and 7 it will be seen that the cam member 302 presents an obstacle to movement of the slide 180 from a first position (shown in FIGS. 3–7) to a second position (shown in FIGS. 8–10) when the cam member 302 is in its locked position. However, as is seen in FIGS. 8 and 9, when the cam 302 is in its unlocked position, the slide 180 is free to move to its second position.

Figure 14:
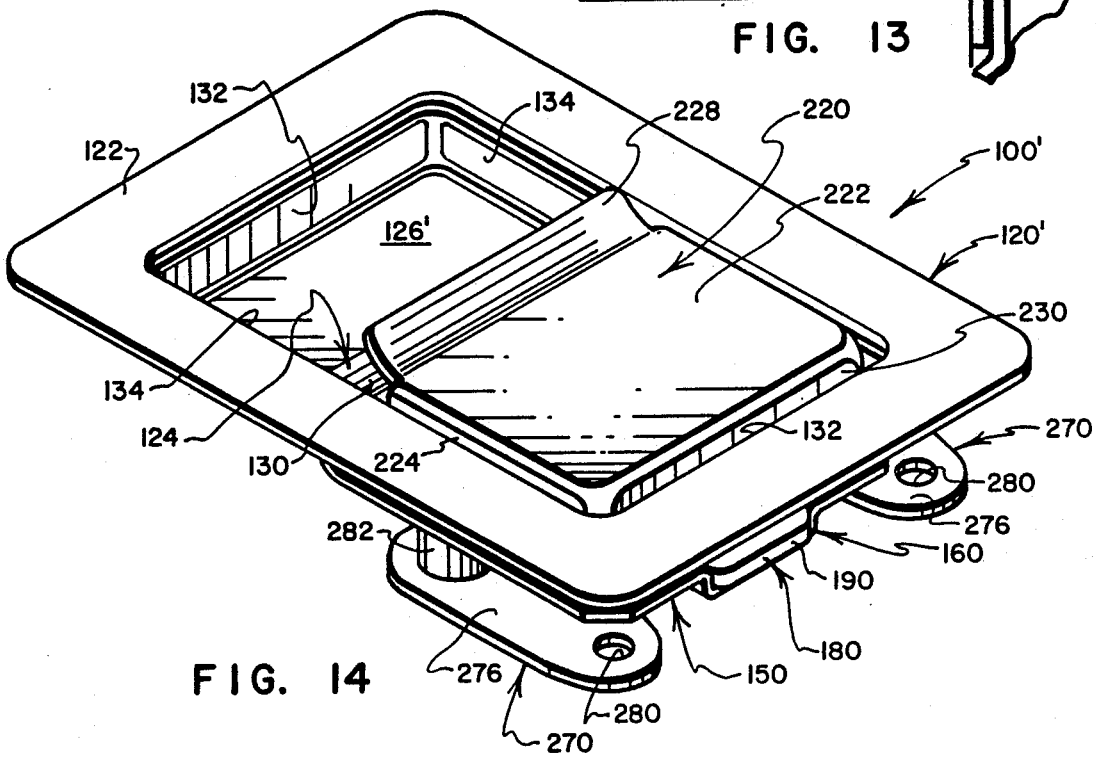

The operating mechanism 100' that is depicted in FIG. 14 is identical to the operating mechanism 100 except that the operating mechanism 100' includes no key operated locking device 300, and the housing 120' includes no mounting hole 146 for mounting the locking device 300 therein. Thus, the operating mechanism 100' is said to be of a "lock" or "locking" type, while the operating mechanism 100' is said to be of a "latch" or "latching" type.

Figure 11:
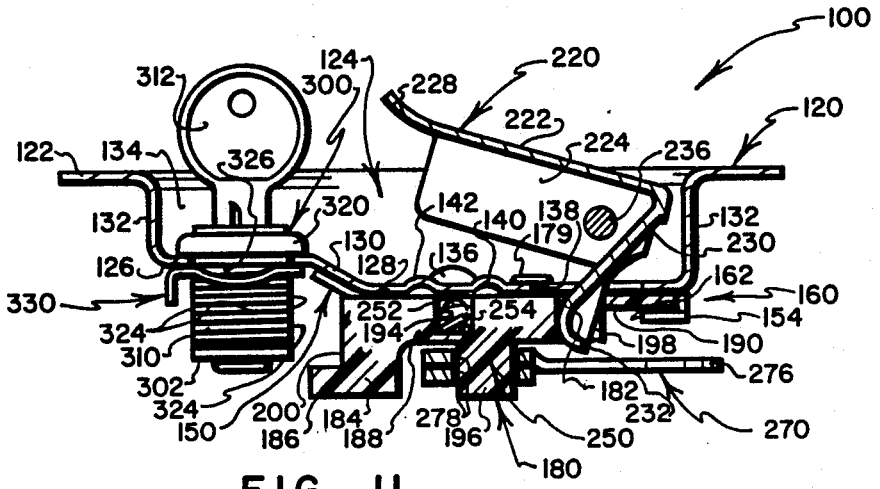
FIG. 11 is a sectional view similar to FIG. 9, but with the view showing illustrating the positioning of components of the mechanism when the handle is between its nested and its operating positions.
Figure 12:
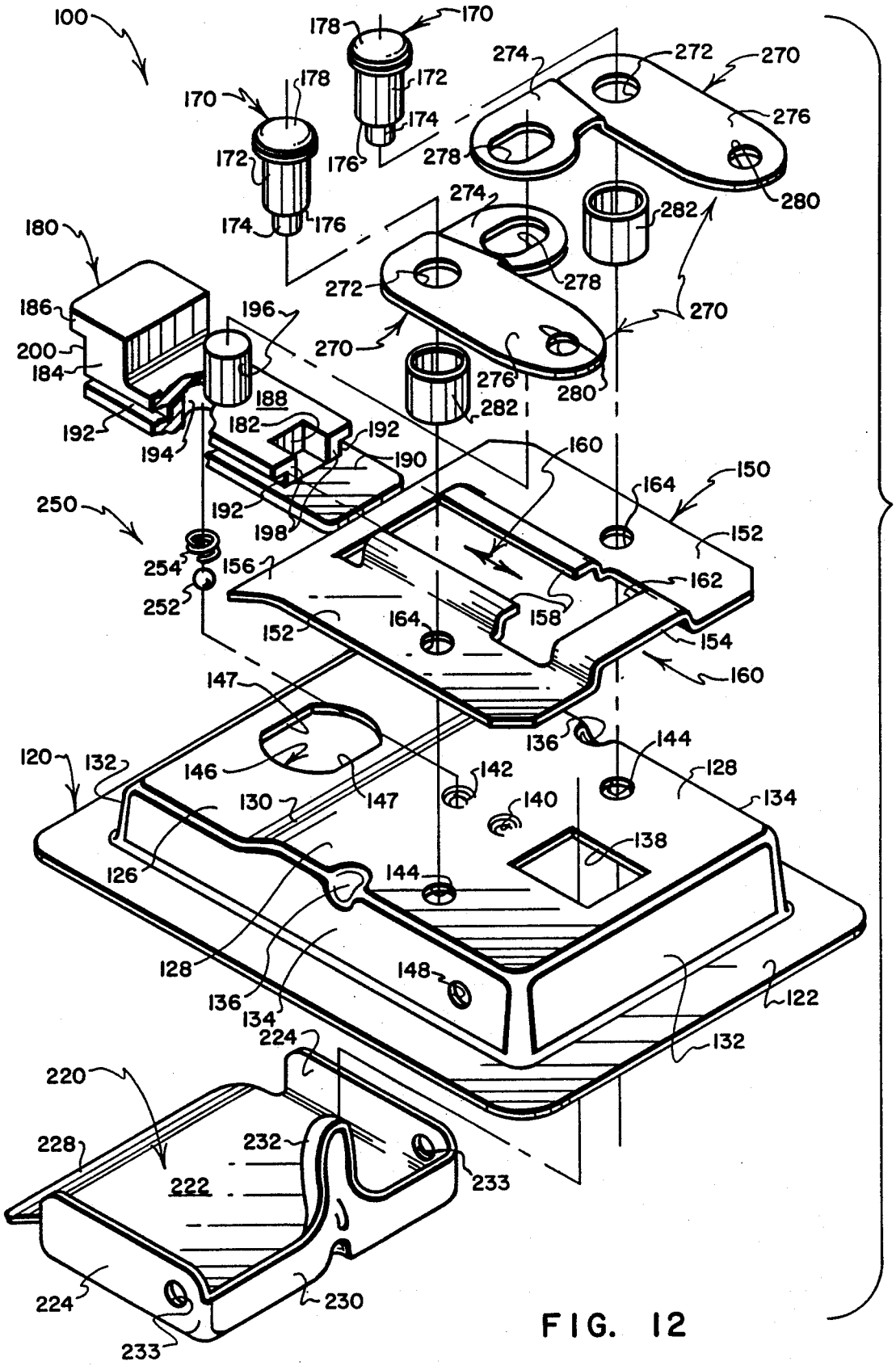
FIG. 12 is an exploded perspective view of selected components of the lock operating mechanism, with the view showing principally rear portions thereof.

Turning now to a more detailed description of features of the operating mechanism 100, and referring initially to FIG. 12, the body 120 is a rectangular, pan-shaped metal stamping having a perimetrically extending mounting flange 122 which surrounds a forwardly facing recess 124. Left and right back wall portions 126, 128 (as viewed in FIGS. 3–12) define levels of different depths in opposite end portions of the recess 124. Referring to FIGS. 6, 7 and 12, an inclined back wall portion 130 interconnects with left and right back wall portions 126, 128. Forwardly extending end walls 132 and side walls 134 connect the back wall portions 126, 128, 139 with the perimetrically extending mounting flange 122.

Other features of the body 120 include a pair of raised stop formations 136 (see FIGS. 6, 7 and 12) that are formed along opposite side regions of the right back wall portion 128, and a pair of dimple-like detent receiving formations 140, 142 (see FIGS. 6 and 12) that are formed in the right back wall portion 128 at spaced locations along the track 160. The stops 136 project into the recess 124 at locations that are near the side walls 134. The stops 136 are engaged by the handle 120 when the handle 120 is in its nested position. Referring to FIG. 12, a pair of rivet holes 144 are formed through the right back wall portion 128 at locations that are between the rectangular opening 138 and each of the stops 136. A key-cylinder mounting hole 146 is formed through the left back wall portion 126. Opposite sides of the hole 146 have flat, parallel-extending surfaces 147. Aligned holes 148 are formed through the side walls 134 near their left ends.

Referring to FIG. 12, the mounting plate 150 has opposite side portions 152 that extend in a common plane and are arranged to extend in intimate contact with the right back wall portion 128 of the housing 120 to reinforce the back wall portion 128. The mounting plate 150 has a U-shaped, rearwardly-extending right end region 154, and an inclined, forwardly-extending left end region 156. A pair of opposed, rearwardly and inwardly turned rail formations 158 connect with the side portions 152 and cooperate with the right end formation 154 to define the track 160. A stop surface 162 is defined by the right end formation 154 near the right end of the track 160. A pair of rivet holes 164 are formed through the side portions 152 in alignment with the rivet holes 144.

Referring still to FIG. 12, a pair of shoulder rivets 170 are provided for assembling several of the components of the locking mechanism 100. The rivets 170 each have a relatively large diameter portion 172, a relatively small diameter portion 174, and a shoulder 176 that forms a transition between the relatively large and small diameter portions 172, 174. The relatively large diameter portions 172 extend from headed ends 178 of the rivets 170 to the shoulders 176. The relatively small diameter portions 174 extend from the shoulders 176 to define the remainder of the lengths of the rivets 170.

During assembly, the relatively large diameter portions 172 are inserted through holes 272 that are formed in the arms 270, and through sleeves 282, whereafter (1) the relatively small diameter portions 174 are inserted through the rivet holes 164, 144 that are formed in the plate 150 and in the back wall portion 128, and (2) end regions of the small diameter portions 174 are swaged to provide flattened head formations 179 (see FIGS. 6, 9 and 11). The flattened head formations 179 overlie front surface portions of the back wall 128 and extend into the forwardly-facing recess 124 of the housing 120. By this arrangement, the mounting plate 150 and the back wall portion 128 of the housing 120 are clamped tightly into overlying relationship between the shoulders 176 and the head formations 179; the relatively large diameter portions 172 of the rivets 170 are rigidly connected to the housing 120 and are caused to extend rearwardly from the mounting plate 150; and the arms 270 are mounted on the relatively large diameter portions 172 for pivotal movement relative to the housing 120 about the axes of the rivets 170.

Because the relatively large diameter portions 172 have lengths (measured axially) that each slightly exceed the combined length of one of the sleeves 282 (measured axially) plus the thickness of one of the arms 270, the arms 270 are not tightly clamped between the rivet heads 178 and the sleeves 282. Stated in another way, the ability of the arms 270 to pivot about the axes of the rivets 170 is not restricted by the swaging of the ends of the rivet portions 174 to provide the head formations 179, whereby the arms 270 remain free to pivot about the axes of the rivets 170.

Referring principally to FIG. 12 in conjunction with FIGS. 4–11, the slide 180 is a solid member which can be formed from plastics material as by injection molding techniques, or from metal utilizing conventional casting or powder metallurgy techniques. The slide 180 has a relatively large left end region 184 with a leftwardly projecting tab 186 that is arranged to overlie the cam member 302 when the key operated locking device 300 is "locked" (see FIGS. 4–7); a central region 188 that has about half the cross-sectional area of the left end region 184; and a rightwardly projecting tab 190 that is configured to extend alongside the right end formation 154 of the mounting plate 150 (see FIGS. 4 and 6). A pair of grooves 192 are formed along opposite sides of the slide 180 to receive the rail formations 158 of the mounting plate 150 to mount the slide 180 for linear movement along the track 160. The opening 182 that receives the handle projection 232 extends through the slide 180 near where the rightwardly extending tab 190 joins the central region 188. A closed-ended hole 194 is formed in the central region 186 and opens forwardly toward the back wall portion 128. A cylindrical projection 196 extends rearwardly from the central region 188 for establishing a pivotal connection with the arms 270, as will be explained.

Other features of the slide 180 include the provision of a stop surface 198 that is engageable with the stop surface 162 on the mounting plate 150 to limit the extent of rightward movement of the slide 180 along the track 160, and the provision of a locking surface 200 that is defined by the left end region 184 of the slide 180 at a location that is forward with respect to the tab 186 (for engaging the cam 302 of the locking device 300, as will be explained).

Figure 10:
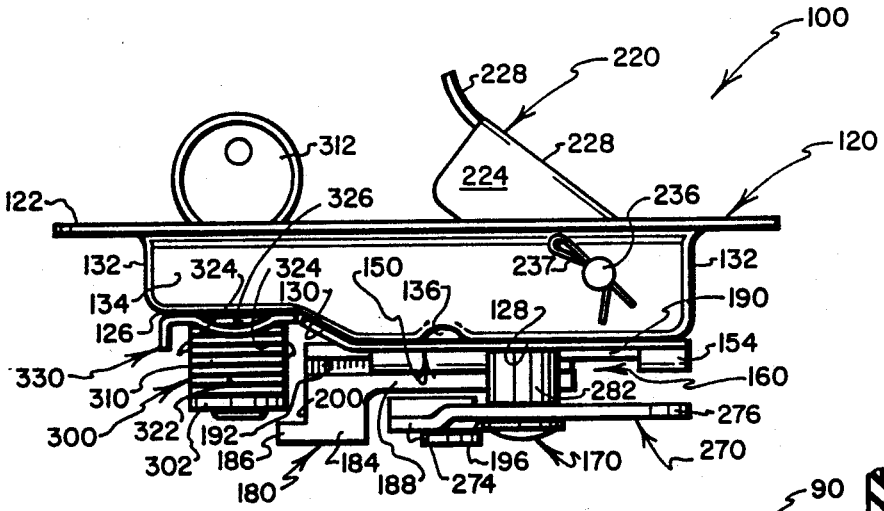
FIG. 10 is a bottom plan view thereof.

The slide 180 is movable along the track 160 between first and second positions. The first position of the slide 180 is a position that is assumed by the slide 180 when the handle 220 is nested, as is shown in FIGS. 5–7. The second position of the slide 180 is a position that is assumed by the slide 180 when the handle 220 is extended, as is shown in FIGS. 8–10. The exact locations of the slide 180 relative to the housing 120 when the slide 180 is in its first and second positions is determined in part by the locations of the closed-ended hole 194 and the dimple-like depressions 140, 142, for, as will be explained, the operation of the detent 250 is governed by the locations of the three formations 140, 142, 194.

Figure 3:
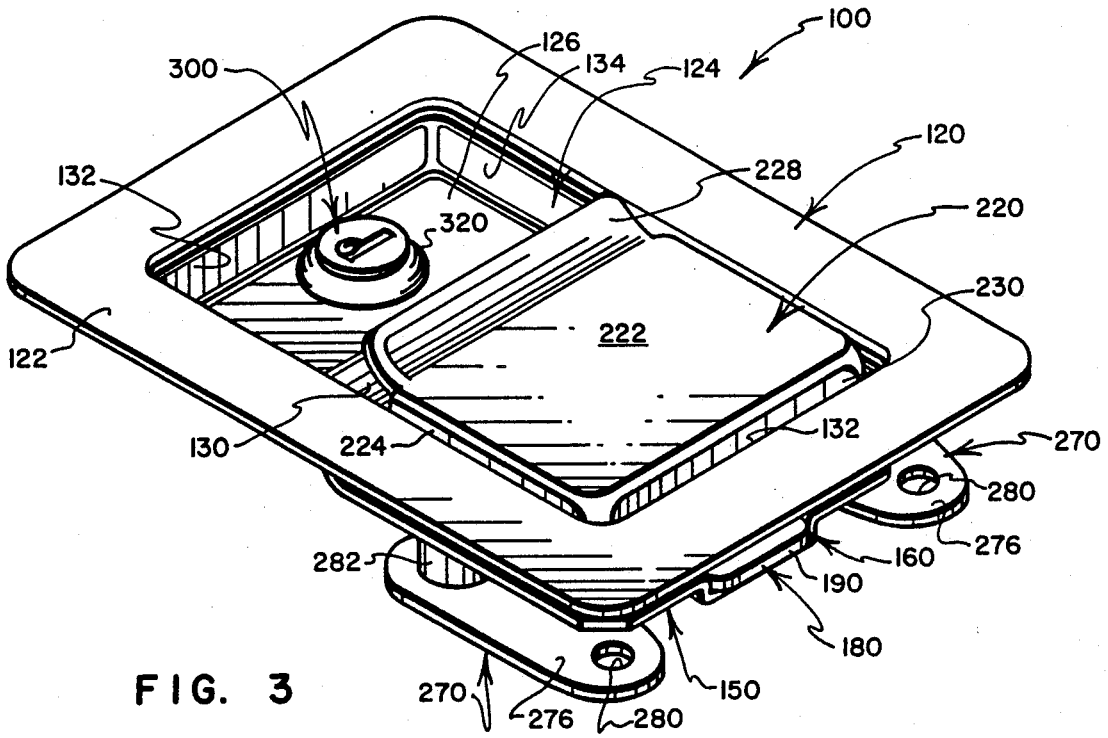
FIG. 3 is a perspective view, on an enlarged scale, of the operating mechanism that is utilized with the locks of FIGS. 1 and 2, with the operating handle of the mechanism in its nested position, and with components of the operating mechanism being "locked," and with the view showing principally front portions of the operating mechanism.
Figure 4:
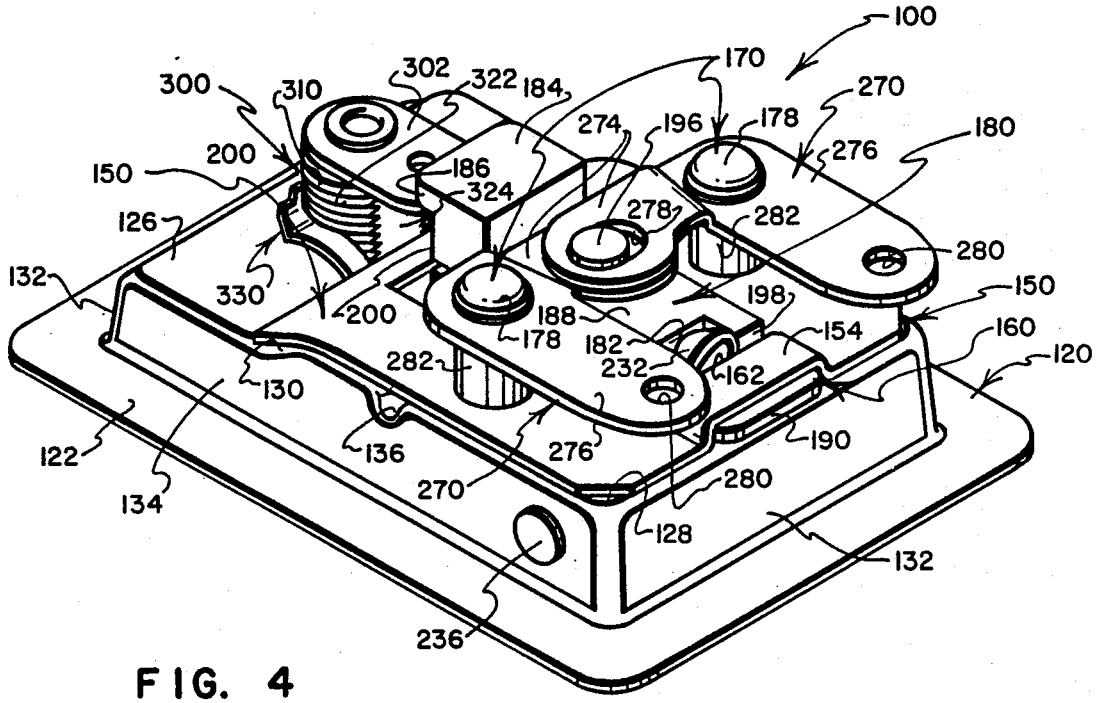
FIG. 4 is a perspective view thereof, but showing principally rear portions of the operating mechanism.

Referring to FIGS. 3, 6 and 12, the paddle handle 220 is a sheet metal stamping having a generally rectangular, substantially flat plate portion 222 and a pair of opposed, inwardly-turned side flanges 224. An outwardly-turned gripping flange 228 is provided at the left end of the handle 220 (as viewed in FIGS. 3–12), and an inwardly-turned operating flange 230 is provided at the right end. The projecting portion 232 that extends through the back wall opening 138 and into the slide formation 182 is formed as an integral part of the operating flange 230.

The handle 22 has aligned mounting holes 233 formed through its side flanges 224. A headed pin 236 extends through the housing holes 148 and through the handle mounting holes 233 to pivotally mount the handle 220 on the housing 120 at a location between the housing's side walls 234. While the headed pin 236 can be swaged at both ends to retain it in position relative to the housing 120, fasteners such as the cotter pin 237 that is illustrated in FIGS. 7 and 10 also can be used to secure the pin 236 in place.

The projecting formation 232 of the handle 220 is matingly received in a slip fit within the receiving formation 182 of the slide 180 such that there is a minimum of "play" therebetween, by which arrangement the handle 220 and the slide 180 are drivingly interconnected for smooth, play-free, concurrent movement. When the slide 180 is releasably retained in its first and second positions relative to the housing 120 (as by a detent 250 that is shown in FIGS. 6, 7 and 9 that is interposed between the slide 180 and the housing 120, as will be explained), the handle 220 is likewise retained in its nested and extended positions, respectively, relative to the housing 120.

Referring to FIGS. 6, 7, 9 and 12, the detent 250 includes a hardened steel ball 252 that is carried in a closed-ended passage 194 that is formed in the slide 180. A compression coil spring 254 is inserted into the passage 192 before the ball 252 is inserted, whereby the spring 254 operates to bias the ball 252 outwardly with respect to the passage 192 (i.e., in a direction that is "forward" with respect to the housing 120) so as to cause the ball 252 to engage the left back wall portion 128 of the housing 120. When the slide 180 is in its first position (i.e., when the handle 220 is nested), the closed-ended hole 194 aligns with the depression 140 (see FIG. 6), and the detent ball 252 is received within the dimple-like depression 140 that is formed in the back wall portion 128. When the slide 180 is in its second position (i.e., when the handle 220 is extended), the closed-ended hole 194 aligns with the depression 142 (see FIG. 9), and the detent ball 252 is received within the dimple-like depression 142 that is formed in the back wall portion 128.

Referring to FIG. 12, the operating arms 270 are of generally L-shaped configuration, with inwardly extending leg portions 274 and rightwardly extending leg portions 276 that join in the vicinity of the openings 272 that are formed through the arms 270 to receive the rivets 170. Slot-like elongate openings 278 are provided in overlapping portions of the inwardly extending legs 274 to receive the cylindrical formation 196 of the slide 180 therein—by which arrangement the arms 270 are caused to be counter-rotated about the axes of the rivets 170 in response to movement of the slide 180 between its first and second positions (i.e., the arms 270 pivot about the axes of the rivets 170 in opposite clockwise and counterclockwise directions so as to either pivot the leg portions 276 toward each other and toward the slide track 160, or to pivot the leg portions 276 relative away from each other and away from the slide track 160). Holes 280 are provided through the leg portions 276 near the rightwardly extending ends thereof to receive pins (not shown) that connect the operating arms 270 with the elongate linkage members 80 of the lock 50 (or the elongate linkage members 80' of the lock 50').

Referring to FIGS. 2–7, the arms 270 are depicted in their normal, non-operating positions. Referring to FIGS. 8–10, the arms 270 are depicted in their operating positions wherein the arms 270 serve to move the elongate linkage members 80, 80' in directions that are indicated in FIGS. 1 and 2, respectively, by arrows 81, 81'.

The key control device 300 includes a lock cylinder 310 into which a key 312 (see FIGS. 6, 7 and 9–11) may be inserted. The key 312 is configured to cooperate with tumblers (not shown) that are housed within the cylinder 310 to permit the cam locking member 302 to be rotated between its locked position (shown in FIGS. 2 and 4–7) and its unlocked position (shown in FIGS. 8–11).

The cylinder 310 is provided with an enlarged head 320 and a threaded body 322. A pair of flats 324 are formed on opposite sides of the threaded body 322. A groove 326 extends perimetrically about the body 322 in the vicinity of the juncture of the body 322 with the head 320. The cylinder 310 is positioned with its head 320 engaging the forward surface of the left back wall portion 126 of the housing 120, with its body 322 extending through the hole 146 and with its flats 324 engaging the flat surfaces 147. Either a conventional lock nut (not shown) is threaded onto the body 322 and tightened into engagement with the back wall surface portion 126, or a conventional spring clip 330 is inserted into the groove 326 to hold the cylinder 310 in place on the housing 120.

While the key locking control device 300 is of a conventional, commercially available type, it is selected from among various commercially available key controls which have particular operational characteristics. These operational characteristics should include key removal capability when the locking cam 302 is positioned in either of its locked and unlocked positions. Once the locking cam 302 has been positioned in either of its locked or unlocked positions and the key 312 has been removed from the cylinder 310, the key control 300 maintains the locking cam 302 in such position. When the cam member 302 is in its locked position, it extends into engagement (or nearly into engagement) with the locking formation 200 that is provided on the left end region of the slide 180 to prevent the slide 180 from moving out of its normal "first" position. When the cam member 302 is in its unlocked position, it stands clear of movement of the locking surface 200 to thereby permit movement of the slide 180 between its first and second positions (whereby movement of the handle 220 between its nested and extended positions, and movement of the arms 270 between their normal and operating positions are likewise permitted).

The described combination and arrangement of operating mechanism components provides an operating mechanism 100 which comprises a relatively small number of parts, very few of which require precision machining. The detent system 250 releasably holds the slide 180 in position relative to the housing 120 and prevents the slide 180 from rattling in the presence of vibration. The detent system 250 also operates to releasably hold the handle 220 in each of its nested and extended positions. Also, the detent system 250 functions to assist in effecting final movement of the slide 180 to its first and second positions. As will be appreciated, when the ball 252 begins its entry into one of the depressions 140, 142, the strong biasing action of the spring 254 will tend to project the ball 252 rapidly into the depression 140 or 142, thereby causing the slide 180 to move as is needed to permit maximum projection of the ball 252 into the depression 140 or 142.

Other features of the preferred practice of the present invention reside in the novel, interfitting configurations, for example of the mounting plate 150 and the slide 180 that provide a track 160 that is bordered on opposite sides by mounting plate rails 158 that are received in slide-carried grooves 192 to securely mount the slide 180 on the housing 120 without obstructing access to the back surface of the slide 180—whereby the rearward extending projection 196 can be used to drivingly engage the operating arms 270 to provide a simple arrangement of parts that strengthen and reinforce each other to provide desirably secure locking system components. The leftwardly extending slide projection 186, for example, overlies the locking cam 302 so as to prevent forcing and bending of the cam 302 which might permit unauthorized operation of the operating mechanism 100 when the key locking device 300 has oriented the cam 302 to "lock" the slide 180 against translation along the track 160.

Although the invention has been described in its preferred form with a certain degree of particularity, it is understood that the present disclosure of the preferred form is only by way of example, and that numerous changes in the details of construction and the combination and arrangements of parts and the like may be resorted to without departing from the spirit and scope of the invention as hereinafter claimed. While "orientation terms" such as "upwardly," "downwardly," "rightwardly," "leftwardly" and the like have been utilized in describing the invention, these terms should not be interpreted as being limiting. It is intended that the patent shall cover by suitable expression in the appended claims, whatever features of patentable novelty exist in the invention disclosed.

What is claimed is:

1. A plural-point latch for mounting on a closure for releasably retaining the closure in a closed position, comprising:

(a) a plurality of latch bolt assembly means for attachment to a closure at a plurality of spaced locations about the periphery of the closure for releasably engaging suitably configured strike formations that are provided adjacent the spaced locations, with each of the latch bolt assembly means including casing means for attachment to the closure, and an associated latch bolt means that is connected to the casing means for movement relative to the casing means into and out of engagement with an associated one of the strike formations;

(b) flush-mountable operating means for flush-mounting on the closure at an operating means location that is remote from each of the plurality of spaced locations;

(c) elongate linkage means for connecting the operating means with the latch bolt assembly means for moving the latch bolt means out of engagement with their associated strike formations in response to operation of the operating means so as to release the latch bolt assembly means from engagement with the strike formations;

(d) wherein the operating means includes:

(i) pan-shaped housing means formed as a metal stamping and having side and back walls that define a forwardly-facing recess that is surrounded by a perimetrically extending mounting flange, with the back wall having a front surface that faces forwardly into the recess, and having a back surface on the opposite side thereof, and with the back wall having an opening that is formed through the back wall;

(ii) mounting plate means formed as a metal stamping for attachment to the back surface of the back wall in the vicinity of the opening that is formed through the back wall, with the mounting plate means having opposed side formation means and opposed end formation means that form a continuous band of material that extends about a central opening that is formed through the mounting plate means, with the opposed side formation means having at least portions thereof that are configured to extend along portions of the back wall that are located on opposite sides of the opening that is formed through the back wall, and with the mounting plate means having track formation means that extend from the opposed side formation means toward the central opening to define a pair of opposed rail means that face toward each other and extend along opposite sides of the central opening, with the opposed rail means extending substantially parallel to each other and being spaced apart by a first distance for defining a slide track that extends along the back wall in the vicinity of the opening that is formed through the back wall, and with the track intersecting with the opening that is formed through the back wall;

(iii) elongate slide means having a pair of opposed, longitudinally extending side portions that face away from each other and are spaced apart by a second distance that is greater than the first distance, with groove means being provided to extend longitudinally along the side portions to define a pair of grooves that are configured to receive the opposed rail means to mount the slide means for movement along the track;

(iv) handle means pivotally mounted on the housing means and being movable with respect to the housing means between a nested position wherein the handle means is nested within the recess, and an extended position wherein at least a portion of the handle means projects forwardly from the recess, with the handle means having a rearwardly extending projection that extends through the opening that is formed through the back wall and that extends into the slide means moves along the track;

(v) receiving formation means provided on the slide means for closely receiving the rearwardly extending projection of the handled means to provide an essentially play-free driving connection between the handle means and the slide means that is operable to cause the handle means and the slide means to move in unison, with the slide means being movable along the track between a first position that is assumed by the slide means when the handle means is in its nested position, and a second position that is assumed by the slide means when the handle means is in its extended position;

(vi) operating arm means for connecting the elongate linkage means to the slide means to effect movement of the elongate linkage means in response to movement of the slide means such that, when the slide means is in its first position, the elongate linkage means permits the latch bolt means to extend into engagement with the strike formations, and when the slide means is in its second position, the elongate linkage means retracts the latch bolt means from engagement with the strike formations, with the operating means including a pair of operating arms each of which is connected to the housing means for pivotal movement relative to the housing means about a separate axis of rotation, and each of which is connected to the slide means so as to be rotated about its associated axis of rotation in response to movement of the slide means between its first and second positions; and, (vii) detent means interposed between the slide means and the housing means, for releasably retaining the slide means in its first and second positions with respect to the housing means, with the detent means including a hole formed in the slide means and opening forwardly toward the back wall of the housing means, a detent element positioned in the hole, biasing means positioned in the hole for biasing the detent element forwardly with respect to the hole so as to project outwardly from the hole and into engagement with the back wall portion of the housing means, and with first and second dimple-like depression means being provided in the back wall portion of the housing means for receiving the detent element when the slide means is in its first and second positions.

2. The plural-point latch of claim 1 additionally including lock means mounted on the housing means and having locking cam means that is movable into and out of a locking position located along the track for selectively permitting and preventing movement of the slide means away from its first position.

3. The plural-point latch of claim 1 wherein:

(a) the back wall of the housing means has a stepped configuration with a first part of the back wall defining a relatively shallow recess portion, with a second part of the back wall defining a relatively deeper recess portion, with a third part of the back wall defining an inclined transition between the first and second parts of the back wall, and with the opening that is formed through the back wall being formed through the second part of the back wall;

(b) the mounting plate means is configured and arranged so that the track along which the slide means moves extends in a direction that crosses all of the first, second and third parts of the back wall;

(c) a lock mounting opening is formed through the first part of the back wall;

(d) the lock means is installed in the lock mounting opening so as to position the locking cam means to extend at least in part at a location behind the first back wall portion, with the locking cam means being oriented to extend across the third back wall portion toward the second back wall portion when the locking cam means is in its locking position;

(e) the slide means has a locking surface provided thereon for extending adjacent the locking cam means when the locking cam means is in its locking position and for abutting the locking cam means in the event that movement of the slide means away from its first position is attempted while the locking cam means is in its locking position; and, (f) the slide means has a projecting portion that extends from the vicinity of the locking surface to overlie the locking cam means when the locking cam means is in its locking position to guard against unwanted bending of the locking cam means and undesired distortion of the mounting of the lock means in the mounting opening.

4. The plural point latch of claim 3 wherein one of the opposed end formation means of the mounting means is configured to extend along the back surface portions of the third part of the back wall to assist in positioning the mounting plate means relative to the housing means.

5. The plural point latch of claim 1 wherein the receiving formation means is a passage that is formed in the slide means and opens toward the back wall of the housing means, and the rearwardly extending projection of the handle means is a smoothly rounded, curved formation that is configured to be received in passage in a slip fit at all times during concurrent movement (1) of the handle means between its nested and extended positions, and (2) of the slide means between its first and second positions, whereby a substantially play-free connection is maintained at all times between the handle means and the slide means.

6. The plural point latch of claim 1 wherein the detent element is a hardened steel ball.

7. The plural point latch of claim 1 wherein:

(a) the pair of operating arms each are of generally L-shaped configuration and have first and second leg portions that extend away from a central region, with the first and second leg portions of each of the L-shaped arms extending substantially perpendicular to each other, with mounting holes being formed through the central regions of the arms;

(b) arm mounting means including a pair of generally cylindrical formations that are connected to the back wall and that extend rearwardly from the back wall at locations on opposite sides of the track for extending through the mounting holes that are formed through the central regions of the arms for mounting the arms on the housing means for pivotal movement relative to the housing means, with the arm means being positioned by the arm mounting means such that the first leg portions of the arms extend into overlapping relationship with each other and overlie the slide means, and such that the second leg portions extend along the back wall on opposite sides of the track;

(c) the slide means includes pivotal connection means in the form of a projection that extends rearwardly from the slide means;

(d) the overlapping parts of the first leg portions have elongate openings formed therethrough that receive the projection that extends rearwardly from the slide means to establish a pivotal connection between the slide means and the operating arms that is operative to counter-rotate the L-shaped arms about the axes of their mounting holes in response to movement of the slide means along the track, with the second end regions of the arm means being caused to pivot relatively toward each other when the slide means is moved toward its second position in response to movement of the handle means toward its extended position, and being caused to pivot relatively away from each other when the slide means is moved toward its first position in response to movement of the handle means toward its nested position; and, (e) the means for connecting the elongate linkage means to the slide means additionally includes link connection means for connecting the second leg portions of the L-shaped arms for with the elongate linkage means.

8. A plural-point latch for mounting on a closure for releasably retaining the closure in a closed position, comprising:

(a) a plurality of latch bolt means for attachment to a closure at spaced locations about the periphery of the closure for engaging suitably configured strike formation to releasably retain the closure in a closed position;

(b) flush-mountable operating means for flush mounting on the closure at a location remote from the latch bolt means;

(c) elongate linkage means for connecting the operating means with the latch bolt means for operating the latch bolt means to release their associated strike formations in response to operation of the operating means;

(d) wherein the operating means includes:

(i) housing means having side and back walls that cooperate to define a forwardly facing recess, and having an opening formed through the back wall;

(ii) mounting plate means for being positioned to overlie at least a portion of the back wall including such parts of the back wall as extend about the opening that is formed through the back wall;

(iii) track formation means defined by the mounting plate means including a pair of rail formations that extending along opposite sides of the opening that is formed through the back wall to define to form a pair of guide structures that extend along the back wall portion in spaced relationship thereto;

(iv) elongate slide means having groove means formed in opposed, longitudinally-extending side portions thereof for receiving the rail formations to establish a sliding connection between the mounting plate means and the slide means, with the side means defining a receiving formation that is located in alignment with the opening that is formed through the back wall during movement of the slide means along the rail formations between first and second positions relative to the housing means;

(v) handle means pivotally mounted on the housing means and being movable with respect to the housing means between a nested position wherein the handle means is nested within the recess, and an extended position wherein at least a portion of the handle means projects forwardly from the recess, with the handle means having a rearwardly extending projection that extends through the opening that is formed in the back wall of the housing, and that extends into the receiving formation to define an essentially play-free driving connection between the handle means and the slide means, whereby the handle means is operable during movement between its nested and extended positions to move the slide means between its first and extended positions, respectively;

(vi) operating arm means including a pair of L-shaped arms that each are pivotally connected to the housing means and to the slide means for concurrent counter-rotation with respect to the housing means in response to movement of the slide means between its first and second positions, with the operating arm means also being connected to the elongate linkage means for effecting operation of the latch bolt means in response to movement of the handle means from its nested position to its extended position, with each of the L-shaped arms having a leg portion thereof that extends into overlapping relationship with a leg portion of the other of the L-shaped arms, and with aligned opening means being formed through the overlapping leg portions of the L-shaped arms;

(vii) the slide means having a rearwardly extending projection means thereon that extends through the aligned opening means to establish a driving connection between the slide means and the L-shaped arms that is operative to pivot the L-shaped arms relative to the housing means in a counter-rotation manner in response to movement of the slide means along the rail formations as the handle means is pivoted between its nested and extended positions; and, (viii) detent means interposed between the slide means and the housing means, for releasably retaining the slide means in its first and second positions with respect to the housing means, with the detent means including a closed-ended hole formed in the slide means and facing forwardly toward the back wall of the housing means, a detent element positioned in the hole, biasing means positioned in the hole for biasing the detent element forwardly with respect to the hole so as to project outwardly from the hole and into engagement with the back wall portion of the housing means, and with first and second dimple-like depression means being provided in the back wall portion of the housing means for receiving the detent element when the slide means is in its first and second positions, respectively, relative to the housing means.

9. The plural-point latch of claim 8 additionally including lock means mounted on the housing means and having locking cam means that is movable into and out of a locking position located along the track for selectively permitting and preventing movement of the slide means away from its first position.

10. The plural-point latch of claim 8 wherein:

(a) the back wall of the housing means has a stepped configuration with a first part of the back wall defining a relatively shallow recess portion, with a second part of the back wall defining a relatively deeper recess portion, with a third part of the back wall defining an inclined transition between the opening that is formed through the back wall being formed through the second part of the back wall;

(b) the mounting plate means is configured and arranged so that the track along which the slide means moves extends in a direction that crosses all of the first, second and third parts of the back wall;

(c) a lock mounting opening is formed through the first part of the back wall;

(d) the lock means is installed in the lock mounting opening so as to position the locking cam means to extend at least in part at a location behind the first back wall portion, with the locking cam means being oriented to extend across the third back wall portion toward the second back wall portion when the locking cam means is in its locking position;

(e) the slide means has a locking surface provided thereon for extending adjacent the locking cam means when the locking cam means is in its locking position and for abutting the locking cam means in the event that movement of the slide means away from its first position is attempted while the locking cam means is in its locking position; and, (f) the slide means has a projecting portion that extends from the vicinity of the locking surface to overlie the locking cam means when the locking cam means is in its locking position to guard against unwanted bending of the locking cam means and undesired distortion of the mounting of the lock means in the mounting opening.

11. An operating mechanism for a plural-point latch of the type that includes a plurality of latch bolt assemblies that are attachable to a closure at a plurality of spaced locations about the periphery of the closure for releasably engaging suitably configured strike formations that are provided adjacent the spaced locations, and that includes a plurality of elongate links for connecting the operating mechanism with the latch bolt assemblies for operating the latch bolt assemblies to release their associated strike formations in response to operation of the operating mechanism, wherein the operating mechanism comprises:

(a) flush-mountable housing means for mounting on the closure, including a pan-shaped housing that is formed as metal stamping and having side and back walls that define a forwardly-facing recess that is surrounded by a perimetrically extending mounting flange, with the back wall having a front surface that faces forwardly into the recess, and having a back surface on the opposite side thereof, and with the back wall having an opening that is formed through the back wall;

(b) mounting plate means formed as a metal stamping for attachment to the back surface of the back wall in the vicinity of the opening that is formed through the back wall, with the mounting plate means having opposed side formation means and opposed end formation means that form a continuous band of material that extends about a central opening that is formed through the mounting plate means, with the opposed side formation means having at least portions thereof that are configured to extend along portions of the back wall that are located on opposite sides of the opening that is formed through the back wall, and with the mounting plate means having track formation means that extend from the opposed side formation means toward the central opening to define a pair of opposed rail means that face toward each other and extend along opposite sides of the central opening, with the opposed rail means extending substantially parallel to each other and being spaced apart by a first distance for defining a slide track that extends along the back wall in the vicinity of the opening that is formed through the back wall, and with the track intersecting with the opening that is formed through the back wall;

(c) elongate slide means having a pair of opposed, longitudinally extending side portions that face away from each other and are spaced apart by a second distance that is greater than the first distance, with groove means being provided to extend longitudinally along the side portions to define a pair of grooves that are configured to receive the opposed rail means to mount the slide means for movement along the track;

(d) handle means pivotally mounted on the housing means and being movable with respect to the housing means between a nested position wherein the handle means is nested within the recess, and an extended position wherein at least a portion of the handle means projects forwardly from the recess, with the handle means having a rearwardly extending projection that extends through the opening that is formed through the back wall and that extends into the path of movement of the slide means when the slide means moves along the track;

(e) receiving formation means provided on the slide means for closely receiving the rearwardly extending projection of the handle means to provide an essentially play-free driving connection between the handle means and the slide means that is operable to cause the handle means and the slide means to move in unison, with the slide means being movable along the track between a first position that is assumed by the slide means when the handle means is in its nested position, and a second position that is assumed by the slide means when the handle means is in its extended position;

(f) operating arm means for connecting the elongate links to the slide means to effect movement of the elongate links in response to movement of the slide means such that, when the slide means is in its first position, the elongate links permit the latch bolt assemblies to extend into engagement with the strike formations, and when the slide means is in its second position, the elongate links retract the latch bolt assemblies from engagement with the strike formations, with the operating means including a pair of operating arms each of which is connected to the housing means for pivotal movement relative to the housing means about a separate axis of rotation, and each of which is connected to the slide means so as to be rotated about its associated axis of rotation in response to movement of the slide means between its first and second positions; and, (g) detent means interposed between the slide means and the housing means, for releasably retaining the slide means in its first and second positions with respect to the housing means, with the detent means including a hole formed in the slide means and opening forwardly toward the back wall of the housing means, a detent element positioned in the hole, biasing means positioned in the hole for biasing the detent element forwardly with respect to the hole so as to project outwardly from the hole and into engagement with the back wall portion of the housing means, and with first and second dimple-like depression means being provided in the back wall portion of the housing means for receiving the detent element when the slide means is in its first and second positions.

12. The operating mechanism of claim 11 additionally including lock means mounted on the housing means and having locking cam means that is movable into and out of a locking position located along the track for selectively permitting and preventing movement of the slide means away from its first position.

13. The operating mechanism of claim 11 wherein:

(a) the back wall of the housing means has a stepped configuration with a first part of the back wall defining a relatively shallow recess portion, with a second part of the back wall defining a relatively deeper recess portion, with a third part of the back wall defining an inclined transition between the first and second parts of the back wall, and with the opening that is formed through the back wall being formed through the second part of the back wall;

(b) the mounting plate means is configured and arranged so that the track along which the slide means moves extends in a direction that crosses all of the first, second and third parts of the back wall;

(c) a lock mounting opening is formed through the first part of the back wall;

(d) the lock means is installed in the lock mounting opening so as to position the locking cam means to extend at least in part at a location behind the first back wall portion, with the locking cam means being oriented to extend across the third back wall portion toward the second back wall portion when the locking cam means is in its locking position;

(e) the slide means has a locking surface provided thereon for extending adjacent the locking cam means when the locking cam means is in its locking position and for abutting the locking cam means in the event that movement of the slide means away from its first position is attempted while the locking cam means is in its locking position; and, (f) the slide means has a projecting portion that extends from the vicinity of the locking surface to overlie the locking cam means when the locking cam means is in its locking position to guard against unwanted bending of the locking cam means and undesired distortion of the mounting of the lock means in the mounting opening.

14. The operating mechanism of claim 13 wherein one of the opposed end formation means of the mounting means is configured to extend along the back surface portions of the third part of the back wall to assist in positioning the mounting plate means relative to the housing means.

15. The operating mechanism of claim 11 wherein the receiving formation means is a passage that is formed in the slide means and opens toward the back wall of the housing means, and the rearwardly extending projection of the handle means is a smoothly rounded, curved formation that is configured to be received in passage in a slip fit at all times during concurrent movement (1) of the handle means between its nested and extended positions, and (2) of the slide means between its first and second positions, whereby a substantially play-free connection is maintained at all times between the handle means and the slide means.

16. The operating mechanism of claim 11 wherein the detent element is a hardened steel ball.

17. The operating mechanism of claim 11 wherein:

(a) the pair of operating arms each are of generally L-shaped configuration and have first and second leg portions that extend away from a central region, with the first and second leg portions of each of the L-shaped arms extending substantially perpendicular to each other, with mounting holes being formed through the central regions of the arms;

(b) arm mounting means including a pair of generally cylindrical formations that are connected to the back wall and that extend rearwardly from the back wall at locations on opposite sides of the track for extending through the mounting holes that are formed through the central regions of the arms for mounting the arms on the housing means for pivotal movement relative to the housing means, with the arm means being positioned by the arm mounting means such that the first leg portions of the arms extend into overlapping relationship with each other and overlie the slide means, and such that the second leg portions extend along the back wall on opposite sides of the track;

(c) the slide means includes pivotal connection means in the form of a projection that extends rearwardly from the slide means;

(d) the overlapping parts of the first leg portions have elongate openings formed therethrough that receive the projection that extends rearwardly from the slide means to establish a pivotal connection between the slide means and the operating arms that is operative to counter-rotate the L-shaped arms about the axes of their mounting holes in response to movement of the slide means along the track, with the second end regions of the arm means being caused to pivot relatively toward each other when the slide means is moved toward its second position in response to movement of the handle means toward its extended position, and being caused to pivot relatively away from each other when the slide means is moved toward its first position in response to movement of the handle means toward its nested position; and, (e) means for connecting the elongate links to the second leg portions of the L-shaped arms for movement in response to movement of the L-shaped arms about the axes of their mounting holes.

18. An operating mechanism for mounting on a closure for connection through a plurality of elongate links with a plurality of latch bolts that are movably mounted on the closure at locations spaced about the periphery of the closure for engaging suitably configured strike formations, and for operating the latch bolts to release their engagement with the strike formations in response to operation of the operating mechanism, wherein the operating mechanism includes:

(a) housing means having side and back walls that cooperate to define a forwardly-facing recess, and having an opening formed through the back wall;

(b) mounting plate means for being positioned to overlie at least a portion of the back wall including such parts of the back wall as extend about the opening that is formed through the back wall;

(c) track formation means defined by the mounting plate means including a pair of rail formations that extending along opposite sides of the opening that is formed through the back wall to define to form a pair of guide structures that extend along the back wall portion in spaced relationship thereto;

(d) elongate slide means having groove means formed in opposed, longitudinally-extending side portions thereof for receiving the rail formations to establish a sliding connection between the mounting plate means and the slide means, with the side means defining a receiving formation that is located in alignment with the opening that is formed through the back wall during movement of the slide means along the rail formations between first and second positions relative to the housing means;

(e) handle means pivotally mounted on the housing means and being movable with respect to the housing means between a nested position wherein the handle means is nested within the recess, and an extended position wherein at least a portion of the handle means projects forwardly from the recess, with the handle means having a rearwardly extending projection that extends through the opening that is formed in the back wall of the housing, and that extends into the receiving formation to define an essentially play-free driving connection between the handle means and the slide means, whereby the handle means is operable during movement between its nested and extended positions to move the slide means between its first and extended positions, respectively;

(f) operating arm means including a pair of L-shaped arms that each are pivotally connected to the housing means and to the slide means for concurrent counter-rotation with respect to the housing means in response to movement of the slide means between its first and second positions, with the operating arm means also being connectable to the elongate links for effecting operation of the latch bolts in response to movement of the handle means from its nested position to its extended position, with each of the L-shaped arms having a leg portion thereof that extends into overlapping relationship with a leg portion of the other of the L-shaped arms, and with aligned opening means being formed through the overlapping leg portions of the L-shaped arms;

(g) the slide means having a rearwardly extending projection means thereon that extends through the aligned opening means to establish a driving connection between the slide means and the L-shaped arms that is operative to pivot the L-shaped arms relative to the housing means in a counter-rotation manner in response to movement of the slide means along the rail formations as the handle means is pivoted between its nested and extended positions; and, (h) detent means interposed between the slide means and the housing means, for releasably retaining the slide means in its first and second positions with respect to the housing means, with the detent means including a closed-ended hole formed in the slide means and facing forwardly toward the back wall of the housing means, a detent element positioned in the hole, biasing means positioned in the hole for biasing the detent element forwardly with respect to the hole so as to project outwardly from the hole and into engagement with the back wall portion of the housing means, and with first and second dimple-like depression means being provided in the back wall portion of the housing means for receiving the detent element when the slide means is in its first and second positions, respectively, relative to the housing means.

19. The operating mechanism of claim 18 additionally including lock means mounted on the housing means and having locking cam means that is movable into and out of a locking position located along the track for selectively permitting and preventing movement of the slide means away from its first position.

20. The operating mechanism of claim 18 wherein:

(a) the back wall of the housing means has a stepped configuration with a first part of the back wall defining a relatively shallow recess portion, with a second part of the back wall defining a relatively deeper recess portion, with a third part of the back wall defining an inclined transition between the first and second parts of the back wall, and with the opening that is formed through the back wall being formed through the second part of the back wall;

(b) the mounting plate means is configured and arranged so that the track along which the slide means moves extends in a direction that crosses all of the first, second and third parts of the back wall;

(c) a lock mounting opening is formed through the first part of the back wall;

(d) the lock means is installed in the lock mounting opening so as to position the locking cam means to extend at least in part at a location behind the first back wall portion, with the locking cam means being oriented to extend across the third back wall portion toward the second back wall portion when the locking cam means is in its locking position;

(e) the slide means has a locking surface provided thereon for extending adjacent the locking cam means when the locking cam means is in its locking position and for abutting the locking cam means in the event that movement of the slide means away from its first position is attempted while the locking cam means is in its locking position; and, (f) the slide means has a projecting portion that extends from the vicinity of the locking surface to overlie the locking cam means when the locking cam means is in its locking position to guard against unwanted bending of the locking cam means and undesired distortion of the mounting of the lock means in the mounting opening.

* * * * *